United States Patent [19]

Brodis et al.

[11] 4,312,688

[45] Jan. 26, 1982

[54] METHOD AND APPARATUS FOR MAKING SIMULATED STAINED-GLASS

[76] Inventors: Eric P. Brodis, 508 Richmond Rd., East Meadow, N.Y. 11554; Anthony Ricca, 23 E. Webster St., Merrick, N.Y. 11566

[21] Appl. No.: 120,389

[22] Filed: Feb. 11, 1980

[51] Int. Cl.[3] ..... B65D 69/00; B44F 1/06; B44C 5/08

[52] U.S. Cl. ..... 156/63; 206/575; 428/38; 428/43; 428/220; 428/344; 428/379; 428/40

[58] Field of Search ..... 35/26; 156/63; 206/575; 428/38, 43, 40, 344, 379, 220; 434/98

[56] References Cited

U.S. PATENT DOCUMENTS

| | | | |
|---|---|---|---|
| 3,382,134 | 5/1968 | Powell | 428/38 |
| 3,420,728 | 1/1969 | Haverstock | 156/63 X |
| 3,713,958 | 1/1973 | McCracken | 156/63 X |
| 3,815,263 | 6/1974 | Oberwager | 428/38 X |
| 3,931,425 | 1/1976 | Kuroda | 428/38 |
| 3,947,992 | 4/1976 | Lemelson | 428/38 X |
| 4,127,689 | 11/1978 | Holt | 428/38 |

FOREIGN PATENT DOCUMENTS

| | | | |
|---|---|---|---|
| 1331354 | 9/1973 | United Kingdom | 428/43 |

*Primary Examiner*—Robert A. Dawson
*Attorney, Agent, or Firm*—Howard Alan Taishoff

[57] ABSTRACT

A method and apparatus for making simulated stained-glass uses an existing surface. An outline of a given design is traced or drawn on the surface to be decorated. Pressure-sensitive lead stripping is applied to the surface in registration with the outline thereby delineating lead-stripped areas. The edges of the lead stripping are boned, sealing same to the surface. Colored, plastic, thin-film stock is cut so as to be complementary in size to a given lead-delineated area, and then applied thereto. The lead stripping resembles a frame that appears to hold the thin-film stock, and it, in conjunction with the translucence of the thin-film, produces an effect that closely resembles real stained-glass.

10 Claims, 13 Drawing Figures

METHOD AND APPARATUS FOR MAKING SIMULATED STAINED-GLASS

This invention relates to a method and apparatus for making simulated stained-glass.

The textures and effects exhibited by stained-glass are appealing. But, making stained-glass is labor intensive and requires great skill. Thus, even the smallest stained-glass pieces are relatively expensive. In order to overcome the high cost involved, several methods and processes have been proposed that simulate stained-glass. Generally, these methods have not met wide acceptance because they either do not look "real," or are too cumbersome to use, or both. For example, there are simulated stained glass articles wherein the lead lines are comprised of opaque plastic. There are simulated stained-glass articles wherein the lead lines are an opaque paste. Then, there are simulated stained-glass processes that use two or three layers of plastic sheet in a laminated sandwich. However, since true stained-glass is not made from paste, and it is not a sandwich of plastic sheets, the above-mentioned articles and processes do not reflect a true stained-glass appearance.

The present invention overcomes several of the significant drawbacks associated with prior processes and apparatus that have been used in making stained-glass articles, and provides for a process that truly is simulative of stained-glass. The inventive apparatus is used in conjunction with an existing planar surface, preferably a glass window. In general, and according to one method of application of the present invention, pressure-sensitive lead stripping is applied to the outside surface of the window thereby delineating lead stripped areas. The edges of the lead stripping are boned, sealing same to the surface of the window. Colored, plastic, thin-film stock is cut so as to be complementary in size to a given lead-delineated area, and applied to the inside surface of the window in facing registration with a given lead-delineated area on the outside surface of the window. Pressure-sensitive lead stripping is then applied to the border or contiguous edges of the plastic film on the inside surface of the window such that complementary lead strips on opposed sides of the window are in registration. The lead stripping on the inside surface of the window is now boned.

To facilitate the initial arrangement of the lead strip on the outside surface of the window, several standard patterns are supplied. These patterns comprise the outline of a given design, for example a star, that is printed on a piece of paper. The pattern that is selected is temporarily placed flush against the inside surface of the window so that the design can be seen from the other side of the window. As the lead stripping is applied to the outside surface of the window, as noted above, the stripping is attached to the glass in facing registration with the outline. Use of these patterns greatly facilitates the making of relatively complicated designs.

When viewed from either side of the window, the lead stripping closely resembles a frame, that, as with real stained-glass, appears to hold the colored stock or film. The translucence of the thin-film stock, in conjunction with the glass backing, produces an effect similar to colored glass. And, as with real stained-glass, the lead stripping of the present invention will, in time, develop a natural patina that adds to an authentic appearance.

It is therefore an object of the present invention to provide a method and apparatus for making simulated stained-glass.

It is a further object of the present invention to provide a means for making simulated stained-glass that is low in cost, and capable of using an existing planar surface or glass window.

It is another object of the present invention to provide a means for making simulative stained-glass that does not require special talent, and that is easy to construct.

It is a further object of the present invention to provide a means for simulating stained-glass art that uses real lead stripping to produce an authentic appearance.

It is a still further object of the present invention to provide a means that will produce the look and texture of leaded glass on existing glass, and that is capable of doing so without glass-cutting or soldering.

It is another object of the present invention to provide a means for simulating stained-glass that can be packaged and sold as a kit.

Other objects and features of the present invention will become apparent from the following detailed description considered in connection with the accompanying drawings. It is to be understood, however, that the drawings are designed for purposes of illustration only, and not as a definition of the limits of the invention for which reference should be made to the appending claims.

In the drawings, wherein the same reference numeral denotes the same element throughout the several views.

Figure 1:
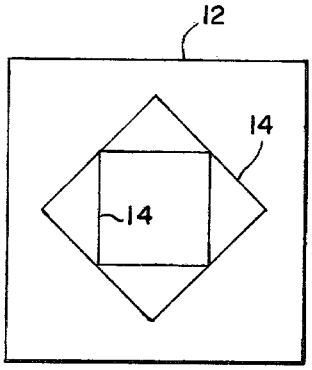
FIG. 1 is a plan view of a selected pattern that is to be copied in the simulated stained-glass process of the present invention, the pattern or outline comprises a given design printed on a piece of paper.
Figure 2:
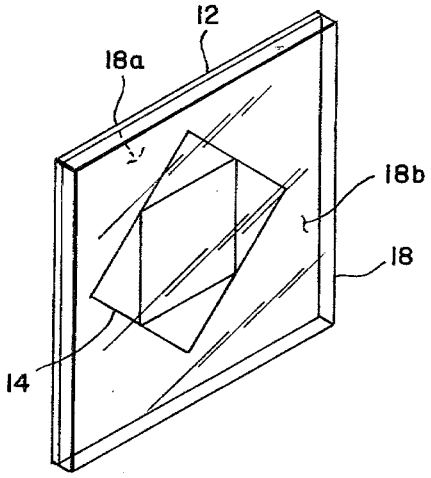
FIG. 2 is a perspective view showing the pattern of FIG. 1 temporarily placed flush against the inside face of an existing window, the pattern faces the glass so that it can be seen from the outside of the window thereby to form an outline for the simulated stained-glass process.
Figure 3:
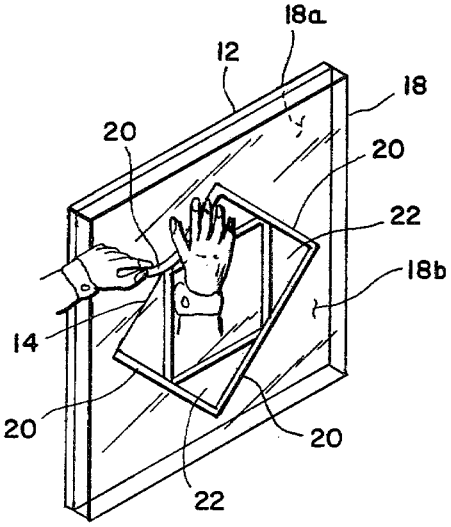
FIG. 3 is a perspective view showing application of the pressure-sensitive lead stripping to the outside face of the window, the lead stripping is applied in facing registration with the outline thereby delinating, in lead strip, the respective areas thereof.
Figure 4:
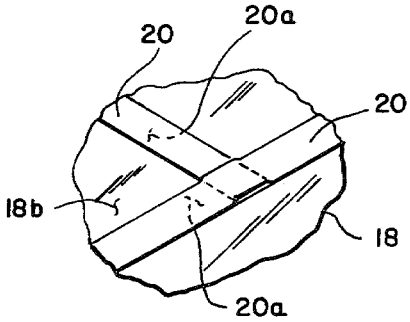
FIG. 4 is an enlarged fragmentary perspective view showing the preferred way of terminating a lead strip.

In detail now and referring to FIGS. 1 through 11, there is shown the sequence of steps of the inventive method, and the apparatus used therewith, as same is applied to a window. The inventive kit includes a plurality of standard patterns that preferably are printed on paper. As seen in FIG. 1, a representitive one of such pattern-sheets 12 carries a printed pattern 14.

The inventive kit further includes a plurality of relatively large sheets of colored, plastic, thin-film stock. Each sheet of thin plastic stock that, in detail, is discussed below, has one surface or face treated with a pressure-sensitive adhesive material. For convenience of packaging and handling, the pressure-sensitive adhesive is covered with a protective covering. Usually, this covering is a waxed paper that peelsoff readily, as is common with such adhesives.

The several areas comprising design 14 are traced onto the colored plastic stock in the following manner. The plastic stock is placed face down on a flat surface with the covered or protected side up. Carbon paper is then placed over the paper-covering or releasable backing presented by the protected face of the thin-film plastic stock. Paper pattern 12 is then placed over the carbon paper. Those areas of design 14 that are to appear in a given thin-film color are traced onto the covered face or releasable paper-backing of the thin-film stock. This step, the tracing of the selected areas of design 14 onto a given thin-film plastic sheet, is then repeated on the various sheets of colored stock supplied with the kit, until the entire design is transferred or traced piecemeal, as it were, onto the several paper-backings of associated colored stock. Put another way, given portions of design 14 selectively are traced onto the releasable backings of correspondingly colored, thin-film stock. The traced areas of design 14 are then cut from respective sheets of thin-film stock giving rise to a plurality of thin-film pieces 16 that correspond to respective areas of design 14. One face of each thin-film piece 16 is, of course, is coated with pressure-sensitive adhesive 16*a*.

Both the inside face 18*a* and the outside face 18*b* of window 18 are cleaned. Pattern-sheet 12 is temporarily placed flush against inside face 18*a* of window 18 so that pattern 14 can be seen through the window when looking from the outside. Lead stripping 20, one face of which carries a pressure-sensitive adhesive 20*a*, and about which more is said below, is then applied to outside face 18*b* of window 18 in facing registration with the outline comprising design 14. Stated differently, lead stripping 20 is applied to the outside face of window 18 in alignment with or directly over a given pattern line of design 14. For best appearance and durability, all ends of the lead stripping should be tucked under an intersecting lead line, where the option permits, in the manner shown enlarged in FIG. 4. When the leading process is complete, a facsimile of design 14 is made in lead strip on outside surface 18*b* of window 18 such that the lead stripping delineates coloring areas 22 that can be seen from both sides of window 18.

Figure 5:
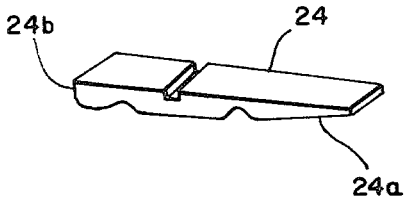
FIG. 5 is a perspective view of a boning tool that is used to bevel the edges of the lead stripping.
Figure 6:
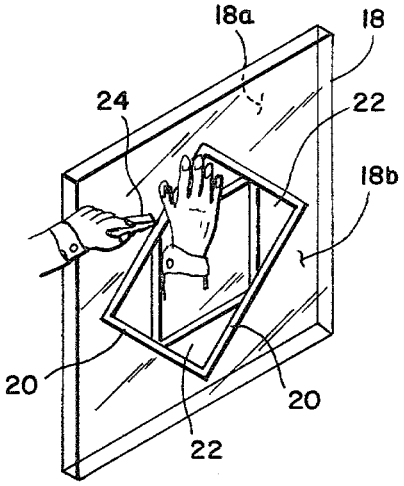
FIG. 6 is a perspective view showing application of the boning or beveling process to the lead stripping that has been applied to the outside surface of the window, the pattern sheet of FIG. 1 has been removed from inside surface of the window.
Figure 7A:
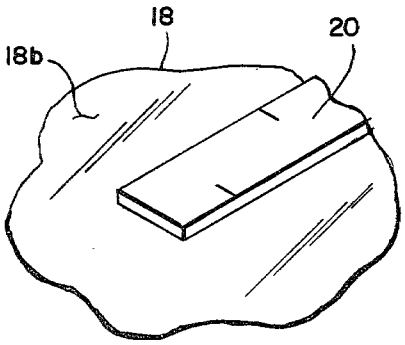
FIGS. 7A and 7B are fragmentary perspective views, drawn on an enlarged scale, showing respective sections of the lead stripping before and after boning.
Figure 7B:
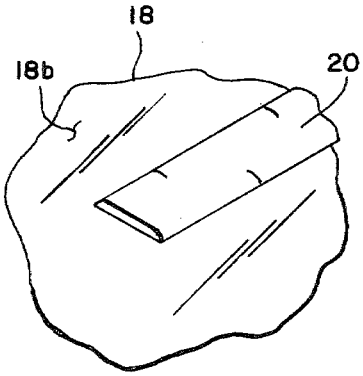

The edges of the lead stripping are then boned or beveled in the following manner. A blunt tool 24, seen in perspective in FIG. 5, is, on one end, defined by a flat boning edge or plane 24*a*. The other end of tool 24 is defined by a handle or pressure head 24*b*. An effective boning tool can be obtained by using one jaw of a conventional wooden close-pin. Boning edge 24*a* is oriented so as to engage an edge of the lead strip. While firm pressure is applied to tool 24, and now reference is made to FIG. 6, plane 24*a* is slid along an edge of the lead, deforming and beveling the same, as shown diagrammatically in FIG. 7*b*. All exposed edges of lead stripping 20 are boned. This process serves permanently to adhere the lead to the glass, and by sealing the edges of the lead, the boning process protects the adhesive from moisture, air, and foreign particulates. In addition, the boning process enhances the appearance of the lead work by giving to it a finished, natural look.

Figure 8:
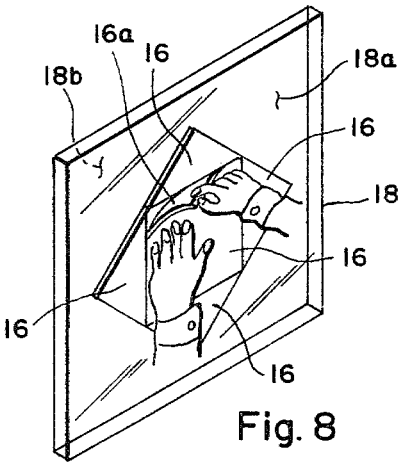
FIG. 8 is a perspective view showing application of the colored, thin-film, plastic pieces to the inside surface of the window, a given piece is seen being placed into a projected correspondingly sized lead-delineated area.

Pattern-sheet 12 is removed from a window face 18*a*. The releasable paper-backing that covers adhesive coating 16*a* on a given individually cut piece 16 is removed. As seen in FIG. 8, each piece 16 is then applied to inside face 18*a* of window 18 in registration with a complementary or correspondingly sized lead-delineated area 22 on the outside surface of window 18. Each piece 16 is pressed firmly against the inside face of window 18 to be held thereon by means of the adhesive film that coats or covers one side of the thin-film plastic piece. When this "coloring" step is completed, a facsimile of pattern 14, in colored plastic film, is transposed onto inside face 18*a* of window 18.

Figure 9:
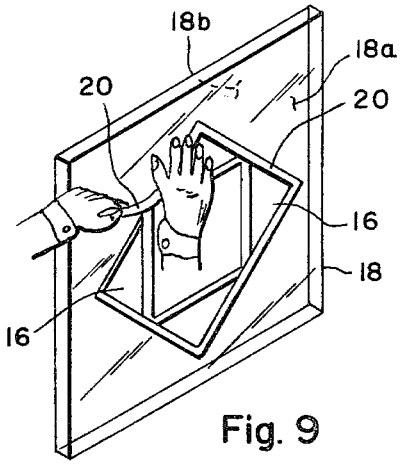
FIG. 9 is a perspective view showing application of the lead stripping to the inside face of the window and along the borders or over the facing edges of contiguous thin-film plastic pieces.
Figure 10:
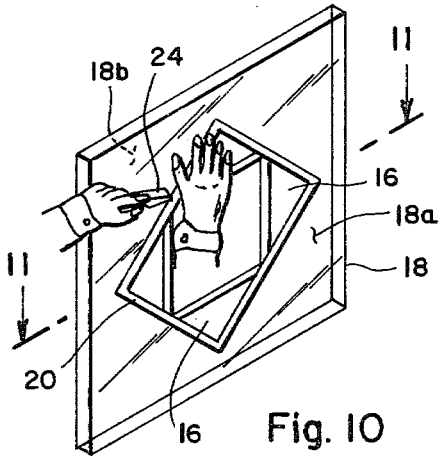
FIG. 10 is a perspective view showing application boning or beveling process to the lead stripping on the inside face of the window.
Figure 11:
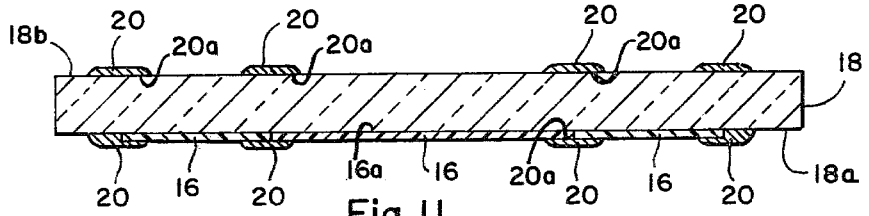
FIG. 11 is an enlarged sectional view taken along the line 11—11 of FIG. 10 and looking in the direction of the arrows to show arrangement of the lead and plastic on the window surface; and, FIG. 12 is a sectional view showing a modified form of the inventive process with the same applied to an opaque wall.

Pressure-sensitive lead stripping 20 is then applied to the edges of the serveral pieces 16, as seen in FIG. 9. Hence, lead stripping 20 is also applied to the inside face of window 18 by placing the lead strips along a given border or joint of the several pieces 18, and then pressing the lead firmly against the window. With this construction, the lead stripping on the inside face of window 18 is in spaced registration with the lead stripping on the outside face of window 18. Where adjacent pieces of plastic film share a common border, or butt up against each other, the lead is applied so that a single strip covers this common border or joint. Where a given piece of thin-film stock has no adjacent neighboring piece, or, where the edges of a given piece 16 end or terminate, so to speak, on open glass, the lead stripping should be applied to the exposed edge so that the lead rests both on window glass and edge regions of the plastic stock. And, as noted above, for best appearance and durability, all ends of the lead stripping should be tucked under an intersecting lead line, where this option permits.

After all edges of the colored film are leaded, the lead stripping on the inside face of window 18 is boned in the manner described above with reference to the lead stripping on the outside face of window 18.

The colored pieces of plastic stock that comprise a given pattern, that is, pieces 16, can be fabricated or cut from the sheet stock in ways other than the tracing and cutting noted above. For example, the tracing step can be eliminated and a more direct approach taken by first leading the outside surface of window 18, in the manner described previously. The selected colored sheet is then placed flush against the inside face of the window. A given piece 16 can now be cut from the sheet stock directly by freehandedly drawing a razor along the centerline of the projected shadow-image cast on the sheet by an associated lead line. Indeed, the several pieces 16 can be supplied precut, for certain standard designs.

Figure 12:
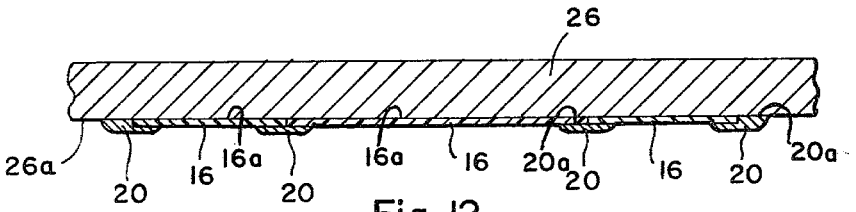

In the discussion of FIGS. 1 through 11, the inventive apparatus and technique is shown applied to an existing window. However, the invention is not to be limited to the sequence described because there are many other ways of using the inventive apparatus. For example, turning now to FIG. 12, there is shown in cross-section, by means of a view analogous to FIG. 11, one such other technique. In the method of FIG. 12, the inventive apparatus is applied to a wall or mirror 26. To accomplish this, the selected outline can be placed on on exposed face 26*a* of wall 26 by tracing, or, the outline can be drawn on the exposed face directly. These traced or drawn lines would then delineate the areas to be "colored." Colored, plastic, thin-film pieces 16 are cut from respective sheets, as noted above, and then placed in or over a correspondingly sized outlined area on surface 26*a*. Pressure-sensitive lead stripping 20 is applied to the respective borders of the several pieces 16 such that a given lead strip covers the edge regions or joints of a given piece 16 and the contiguous portions of surface 26*a*. The edges of the lead stripping are then boned in the manner noted previously. It should be clear, too, that the preceeding sequences of steps that are applied to wall or mirror surface 16*a* can be interchanged, although doing so will require greater skill. Hence, after the outlne of the selected design is traced or drawn on surface 26*a*, the pressure-sensitive lead stripping would then be applied to surface 26*a* in registration with the outline. This would delineate lead stripped areas on surface 26*a*. Next, the lead is boned. Then, after pieces 16 have been cut and sized correspondingly, as noted above, a given piece 16 would be applied to an associated lead-delineated area on surface 26*a* thereby to form the simulated design.

In the discussion of FIGS. 1 through 12, the "coloring" or thin-film plastic stock can be applied to the window dry. That is, the paper-backing is removed from the colored film and then the film is carefully applied to a respective area on the window or wall surface. However, this method is somewhat critical in the initial alignment of the colored film relative to its delineated area. This is so because the pressure-sensitive colored film exhibits great adhesion to dry surfaces and this makes difficult any shifting or correction of the plastic stock as the same is laid or placed on the surface to be decorated. To overcome this problem, the colored film can be applied "wet" in the following manner. The window area is sprayed with a liquid window cleaner and left wet. The releasable paper-backing is removed from adhesive coating 16*a* on a given piece of plastic film. The piece of plastic film is placed on the wet glass or surface with the pressure sensitive adhesive facing the glass. The liquid interface between the adhesive on the one side, and the glass on the other, causes the given piece of plastic film to float, as it were, on a thin-film of liquid allowing the piece to be maneuvered into position in the lead-delineated area, or drawn outline, as the case may be. A soft sponge or rubber squeege is then used to remove air bubbles and excess window cleaner from under the colored film. In a relatively short time, usually ten to twenty-four hours, the liquid film will evaporate causing the colored film to "set" or adhere to the window surface.

In the discussion of FIGS. 1 through 11, the sequence of steps applied to the inside surface of window 18 consisted of applying the plastic film first, and then the application of lead stripping. However, it is to be understood clearly that the invention is not to be limited to order of steps enumerated. For it is within the scope of this invention to apply the lead stripping first, and then apply the plastic film using the wet or dry technique described above. Moreover, since the pressure-sensitive adhesive is pigmented black preferably, it is possible to delete the lead stripping on the outside surface of window 16, and, by applying the inventive technique to the inside surface of the window only, produce and attractive design when seen from the outside, and an authentic design when viewed from the inside.

Then, too, while it is preferred that the boning step immediately follow the application of the lead stripping, the invention is not to be limited to this sequence. For it is possible to apply the lead stripping first, then color, and then bone or bevel the edges of the lead strips over contiguous edges or joints of the colored, plastic film.

For added effect, two or more pieces of complementary cut plastic film, either of the same or different colors, can be stacked to produce unique shades and textures. Indeed, for certain designs it might be desirable to supply the plastic sheet stock in a given kit as shades of one color only. Thus, a given kit might be sold as a "brown" kit wherein all the plastic sheet stock are various shades of brown, or a "blue" kit wherein all the plastic sheet stock are various shades of blue.

The plastic, thin-film, sheet stock of the present invention is colored by silk-screening various colored inks onto the surface of the film. Hence, in choosing suitable plastic thin-film stock, care must be taken to insure that the film be clear, non-yellowing, and unbreakable from a handling standpoint. Polyester film, under the tradename Mylar, is an excellent choice for the plastic, thin-film stock of the present invention. Other plastic films can be used such as acrylic or polycarbonate. Films made from either vinyl, or polystyrene, or acetate meet some of the above-noted criteria but not others, and therefore have been found to be unsuitable, so far. The film thickness of the Mylar used in the present invention is 1 mil (0.0254 mm). And, in addition to coloring the film by silk-screening, as previously mentioned, it would be possible to apply color to this film by other methods, such as spraying or roller-coating. There are various inks commercially available for polyester, such as those manufactured by Avance and Nazdar, as well as others. The ink colors that are silk-screened onto the plastic film of the present invention should be non-fading and non-bleeding, and exhibit desirable aging characteristics. Both opaque and transparent colors can be used, and they are available readily from the above-mentioned suppliers. Being more specific, a typical silk-screen ink used to color the clear thin-film Mylar is manufactured by Advance, and is designeated RAM-546 Process Blue.

The adhesive material which is applied to one side of the plastic film must exhibit good adhesive properties, and have good long-term aging characteristics. Typical pressure-sensitive adhesives are based on either polyvinyl acetate, rubber or acrylic. These systems are available in both water and solvent base. Acrylic has been found to be the only one so far that meets the requirements of durability and non degradation of adhesion. Both a water-base product and a solvent-base acrylic adhesive have been employed successfully. Polyvinyl acetate and rubber based adhesives have been tried, but they do not age as well as acrylic.

In addition to coloring the thin-film plastic by silk-screening, roller-coating, and like processes, it is possible to color the film by pigmenting or dying the pressure-sensitive adhesive material, or by pigmenting or dying the clear film internally, i.e., throughout its mass. Coloring the plastic film by pigmenting or dying the adhesive, as opposed to coloring by silk-screening, might add to the overall durability of the color since the adhesive material is, for the most part, inaccessible during handling, packaging, and cutting. And, in use, a colored adhesive would be protected by its placement between the glass on the one side and the plastic film on the other.

The lead used in the lead stripping, ideally, should be pure. Leads are available with alloying elements which can dramatically change the properties of the lead so that it can be used as lead stripping in the instant invention. As little as 1% tin and antimony has proved to be unsatisfactory, in that it makes the lead too strong. If the lead is too strong, it will not yield to the various processes necessary to produce a finished product. Evaluation of as little as 0.01% of tin showed no problems.

The thickness of the lead is also critical from the standpoint of appearance, as well as application. A 0.020 inch (0.508 mm) thick lead has been found satisfactory. Higher film thickness make the lead unmanageable, and thinner film thicknesses will result in the lead strips breaking, and not produce an authentic appearance.

In the present invention the lead stripping is supplied as grooved sheet stock having the 0.020 inch (0.508 mm) thickness noted above. The individual lead strips are torn from this sheet as needed. Hence, a plurality of parallel spaced grooves are placed on one face of the lead sheet stock. The parallel grooves are separated by a distance of approximately 0.22 inches (5.59 mm), yielding a strip that is approximately 0.20 inches (5.08 mm) wide. It is essential that the grooves be deep enough to allow a given strip to tear from the sheet easily, but not be so deep that it would cut through the lead and produce individual strips. Since the lead sheet is 0.020 inches (0.508 mm) thick, the grooves should be 0.018 inches (0.457 mm) deep, leaving a 0.002 inch (0.051 mm) thickness of lead at the bottom of each groove.

The pressure-sensitive adhesive that is applied to one face of the lead sheet, and hence to the lead stripping, is the acrylic mentioned above. Both the water base product and a solvent base acrylic adhesive is used. However, for aesthetic reasons, the adhesive that is applied to the lead sheet or stripping is pigmented black.

The inventive apparatus and method will find a variety of uses. In residential use, the apparatus can be applied to windows, mirrors, shutters, and partitions, to name a few. In cars and vans, the invention can be applied to back windows, side windows, panels, and the like. In general commercial use, the invention will find application in window displays, lettering, designs, and logos.

While only a few embodiments of the present invention have been shown and described, it is to be understood that many changes and modifications can be made hereto without departing from the spirit and scope hereof.

What is claimed is:

1. A kit for constructing simulated stained-glass on an existing surface comprising at least one sheet of plastic, thin-film stock from which one or a plurality of individually sized pieces can be cut, lead stripping, a pressure-sensitive adhesive applied respectively to one face of said sheet of thin-film stock and to one face to said lead stripping, a removeable protective covering applied to the adhesively coated face of said sheet of thin film stock, a plurality of designs each having defined border lines and printed on substantially flat stock, said designs being used to facilitate the simulation of a given one of such designs in said lead stripping and individually size pieces, whereby when said lead stripping and individually sized pieces are attached to the existing surface, the adhesively coated face of said lead stripping and individually sized pieces adhere permanently to the surface and thereby simulate the look of stained-glass.

2. The kit of claim 1, a plurality of sheets of colored, plastic, thin-film stock, a pressure-sensitive adhesive applied to one face of each of said sheets of thin-film stock.

3. The kit of claim 2, each of said designs being placed on a sheet of paper.

4. A kit for constructing simulated stained-glass on a glass surface including a plurality of colored plastic sheets, each of said plastic sheets being comprised of thin-film stock, a pressure-sensitive adhesive applied to one face of each of said plastic sheets, a removeable protective covering applied to the adhesively coated face of each of said plastic sheets, thin lead sheet stock on one face of which a plurality of generally parallel spaced grooves are inscribed, said grooves permitting individual lead strips to be torn from said thin lead sheet stock, a pressure-sensitive adhesive applied to one face of said thin lead sheet stock such that when the lead strips are torn from said thin lead sheet stock, one face thereof is coated with said pressure-sensitive adhesive, and a plurality of individual designs each of which is defined by printed border lines such that any one of said designs can be temporarily attached to one face of the glass surface and thereby form a pattern for the placing of cut-out pieces of said plastic sheet and the lead strips on the glass surface.

5. The kit of claim 4, a tool for beveling the edges of the lead strips after the same is applied to the glass surface.

6. A kit for making simulated stained-glass on an existing surface including a plurality of colored plastic sheets, each of said colored sheets being comprised of thin-film stock, a pressure-sensitive adhesive applied to one face of each of said colored sheets, a releasable protective cover applied to each adhesively coated face of said colored sheets and adapted to be readily removed therefrom, thin lead sheet stock approximately 0.020 inches (0.50 mm) thick, a pressure-sensitive adhesive applied to one face of said lead sheet stock, a plurality of substantially parallel spaced grooves placed on one face of said lead sheet stock thereby to permit lead strips to be torn therefrom, said grooves, in plan view, being spaced or separated by a distance of approximately 0.22 inches (5.6 mm) and having a vertical height or depth of cut of approximately 0.018 inches (0.46 mm) thereby to leave a 0.002 inch (0.05 mm) thickness of lead at the bottom of each of said grooves so that when an individual lead strip is torn from said lead sheet stock, the individual lead strip is approximately 0.20 inches (5.1 mm) wide with one face of same coated with said pressure-sensitive adhesive, said pressure-sensitive adhesive on said colored sheets and said lead sheet stock allowing the lead strips and cut-out portions of said colored sheets to be attached to the existing surface, and a plurality of designs each of which is defined by printed border lines thereby to form a pattern for the arrangement of the lead strips and said cut-out portions on the existing surface.

7. A method of constructing simulated stained-glass on an existing surface comprising the steps of cutting a plurality of individually sized thin-film plastic pieces from a sheet of such stock wherein one face of such stock is coated with a pressure-sensitive adhesive that is protected by a releasable covering, removing the releasable covering from the individually sized thin-film plastic pieces after the same have been cut, applying the individually sized thin-film plastic pieces to the existing surface with the adhesively coated face thereof facing and adhering to same, pressing the individually sized thin-film plastic pieces against the existing surface, applying pressure-sensitive lead stripping to the existing surface such that the lead stripping resembles a frame in which the individually sized thin-film plastic pieces appear to be held, and boning the edges of the lead stripping thereby to produce simulative stained-glass on the existing surface.

8. A method of constructing simulated stained-glass on an existing surface including the steps of applying pressure-sensitive lead stripping to the existing surface such that the lead stripping forms a given outline and delineates lead stripped areas, boning the edges of the lead stripping sealing the same against the existing surface, cutting a plurality of individually sized thin-film plastic pieces from a sheet of such stock wherein one face of such stock is coated with a pressure-sensitive adhesive that is protected by a releasable covering and wherein a given individual thin-film plastic piece is sized complementary with a correspondingly sized lead-delineated area, removing the releasable covering from the individually sized thin-film plastic pieces after the same have been cut, and applying the individually sized thin-film plastic pieces to a correspondingly sized lead-delineated area on the existing surface with the adhesively coated face of a given individually sized thin-film plastic piece facing and adhering permanently to same such that the lead stripping resembles a frame that appears to hold the individually sized thin-film plastic pieces.

9. The method of claim 8, said step of applying the individually sized thin-film plastic pieces to the lead-delineated areas on the existing surface being accomplished by wetting the existing surface, and placing the individually sized thin-film plastic pieces on the wetted surface thereby facilitating the moving of a given one of the last-mentioned pieces relative to its correspondingly sized lead-delineated area.

10. For use in a kit to make simulated stained-glass on an existing surface wherein the stained-glass simulation uses colored, thin-film, plastic stock and lead strips, a sheet of lead stock approximately 0.020 inches (0.50 mm) thick, a pressure sensitive adhesive applied to one face of said lead sheet stock, and a plurality of substantially parallel grooves placed on one face of said lead sheet stock thereby to permit lead strips to be torn therefrom, said grooves, in plan view, being spaced or separated by a distance of approximately 0.22 inches (5.6 mm) and having a vertical height or depth of cut of approximately 0.018 inches (0.46 mm) thereby to leave a 0.002 inch (0.05 mm) thickness of lead at the bottom of each of said grooves so that when an individual lead strip is torn from said lead sheet stock, the individual lead strip is approximately 0.20 inches (5.1 mm) wide with one face of same coated with said pressure-sensitive adhesive.

* * * * *